US008579147B2

(12) United States Patent
Dubois et al.

(10) Patent No.: US 8,579,147 B2
(45) Date of Patent: Nov. 12, 2013

(54) COLLAPSIBLE TRANSPORT AND STORAGE CONTAINER

(75) Inventors: Jean-Marc Dubois, Engelberg (CH); Yves Hug, Lieli (CH)

(73) Assignee: Georg Utz Holding AG, Bremgarten (CH)

( * ) Notice: Subject to any disclaimer, the term of this patent is extended or adjusted under 35 U.S.C. 154(b) by 50 days.

(21) Appl. No.: 12/999,523

(22) PCT Filed: Jun. 8, 2009

(86) PCT No.: PCT/IB2009/052410

§ 371 (c)(1), (2), (4) Date: Mar. 10, 2011

(87) PCT Pub. No.: WO2009/153693

PCT Pub. Date: Dec. 23, 2009

(65) Prior Publication Data

US 2012/0006834 A1 Jan. 12, 2012

(30) Foreign Application Priority Data

Jun. 17, 2008 (CH) ..... 00921/08

(51) Int. Cl.
*B65D 6/18* (2006.01)
*E05C 3/04* (2006.01)

(52) U.S. Cl.
USPC ..... 220/666; 292/207; 292/169

(58) Field of Classification Search
USPC ..... 220/666, 7, 6, 4.28, 6.7; 292/207, 128, 292/101, 169, 700, 137, 175, 145, 150, 138, 292/DIG. 38, DIG. 63
See application file for complete search history.

(56) References Cited

U.S. PATENT DOCUMENTS

| | | | | |
|---|---|---|---|---|
| 4,674,647 | A * | 6/1987 | Gyenge et al. | 220/6 |
| 4,923,079 | A * | 5/1990 | Foy | 220/7 |
| 5,161,709 | A * | 11/1992 | Oestreich, Jr. | 220/6 |
| 5,853,099 | A * | 12/1998 | Lessard | 220/7 |
| 6,722,515 | B2 * | 4/2004 | Rumpel | 220/6 |
| 6,772,897 | B2 * | 8/2004 | Kellerer et al. | 220/7 |
| 6,843,386 | B2 * | 1/2005 | Raghunathan et al. | 220/7 |
| 7,195,128 | B2 * | 3/2007 | Murakami et al. | 220/7 |
| 2003/0146213 | A1 | 8/2003 | Kellerer et al. | |
| 2005/0098556 | A1 * | 5/2005 | Kellerer | 220/7 |
| 2009/0064595 | A1 * | 3/2009 | Yates | 49/506 |

FOREIGN PATENT DOCUMENTS

| | | |
|---|---|---|
| EP | 1 655 232 A | 5/2006 |
| WO | WO 2006/132613 A | 12/2006 |

* cited by examiner

*Primary Examiner* — J. Gregory Pickett
*Assistant Examiner* — Ernesto Grano
(74) *Attorney, Agent, or Firm* — Henry M. Feiereisen LLC

(57) ABSTRACT

A collapsible plastic storage and transport container has four sidewalls configured to be collapsible inwardly towards a bottom part. Two opposing first sidewalls have recesses and upper corner regions with a spring clip. The spring clip is fixedly connected to a first sidewall and has a free end with a locking projection. The other two opposing second sidewalls have detents disposed on edges of the two second sidewalls. The free end of the spring clip is moveable in a plane of the first sidewall against a spring force of the spring clip, and the locking projection engages behind a corresponding detent to lock the first sidewalls with the second sidewalls. The upper corner regions of the first sidewalls are double-walled, with a closed outer surface and an inner surface with a grip hole. Each spring element can only be actuated from inside the container.

4 Claims, 2 Drawing Sheets

COLLAPSIBLE TRANSPORT AND STORAGE CONTAINER

CROSS-REFERENCES TO RELATED APPLICATIONS

This application is the U.S. National Stage of International Application No. PCT/IB2009/052410, filed Jun. 8, 2009, which designated the United States and has been published as International Publication No. WO 2009/153693 and which claims the priority of Swiss Patent Application, Serial No. 00921/08, filed Jun. 17, 2008, pursuant to 35 U.S.C. 119(a)-(d).

BACKGROUND OF THE INVENTION

The invention relates to a plastic collapsible storage and transport container.

Collapsible storage and transport containers of this type, wherein the sidewalls can be completely collapsed inwardly or outwardly, are known in the art and are also referred to as collapsible boxes. Conversely, folding boxes have foldable end walls and foldable sidewalls with an upper frame enhancing the stability of the folding box. Collapsible containers are frequently used to transport household items as well as for general storage and transport. Because valuable or sensitive goods are transported in such containers particularly in commercial applications, these containers must also be provided with a security device, for example in form of a seal to prevent the container from being opened by unauthorized persons. The containers with collapsible sidewalls have in common that the collapsible sidewalls are releasably connected with each other at their upper edge and do not have an upper frame. Stabilization is mostly attained by hinged two-part top covers, thus likewise providing optimal protection of the goods. However, locking the sidewalls will in most situations not prevent the container from being manipulated or opened by unauthorized persons.

It is therefore an object of the present invention to provide a collapsible storage and transport container of the aforedescribed type with an interlock for the sidewalls, which should prevent manipulation, should be easy to manufacture and to assemble, and easy to handle.

SUMMARY OF THE INVENTION

This object is attained with a collapsible storage and transport container having a bottom part and four sidewalls arranged in an articulated manner on the bottom part and configured to be collapsible inwardly towards the bottom part. Two opposing first sidewalls of the four sidewalls have recesses and upper corner regions and at least one catch bolt embodied as a spring clip associated with each upper corner region and arranged in a recess of the first sidewall, wherein the spring clip has an end which is fixedly connected to a first sidewall and a free end with a locking projection. The other two opposing second sidewalls of the four sidewalls have detents disposed on edges of the two second sidewalls. The free end of the spring clip with the locking projection is moveable in a plane of the first sidewall against a spring force of the spring clip, and the locking projection engages behind a corresponding detent to lock the first sidewalls with the second sidewalls in the corner regions.

A significant advantage of the invention is that the interlock for the sidewalls of the container cannot be manipulated from the outside and that the container can be easily collapsed and set up again. Installation of the lock on the sidewall of the container is simple and quick, which reduces the manufacturing costs of the container.

BRIEF DESCRIPTION OF THE DRAWING

It is shown in.

DETAILED DESCRIPTION OF PREFERRED EMBODIMENTS

In the Figures, identical reference symbols are used for identical elements and the initial descriptions apply to all Figures, unless explicitly stated otherwise.

The collapsible plastic storage and transport container according to the invention has a bottom part and four foldable sidewalls arranged in an articulated manner on the container bottom and preferably collapsible inwardly towards the bottom. Each of two opposing first sidewalls 2 can be detachably locked with the other two opposing second sidewalls in the corner regions of the collapsible storage and transport container. To this end, the two first sidewalls 2 have catch bolts 1 arranged in the two upper corner regions, which can engage behind corresponding detents disposed on corresponding edges of the two second sidewalls for locking the opened sidewalls.

Figure 1:
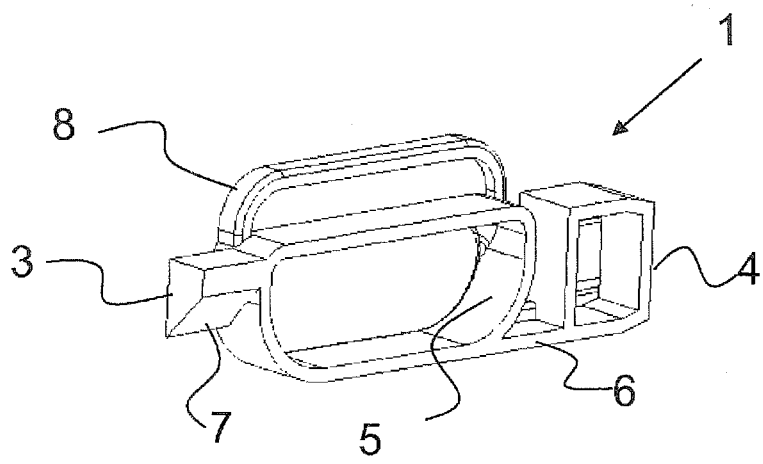
FIG. 1 a perspective view of a lock with the outside facing forward.

FIG. 1 shows an exemplary embodiment of a catch bolt 1 of this type in a perspective view with the outside facing forward. The catch bolt 1 is embodied as a spring clip 6, wherein the spring clip 6 has an end 4 which is to be fixedly connected with the first sidewall 2 of the container. This end 4 of the spring clip 6 is formed by an integrally formed catch element 4 configured to be received in a complementary recess in the first sidewall 2. A grip element 5 is integrally formed on the spring clip 6 in the center region of the spring clip 6 between the catch element 4 and the free end 3. The grip element 5 is essentially formed by an oval operating handle 5 with rounded bead-shaped edges 10, with a bezel 8 extending upwardly and parallel to the sidewall 2. A locking projection 3 configured for engagement with a detent disposed on the second sidewall is formed on the free end 3 of the spring clip 6. The locking projection 3 has an inclined surface 7. When raising a first sidewall 2, its spring clip 6 is moved upward against the spring force of the spring clip 6 and by producing restoring forces generated by the detent of a second sidewall which runs up on the locking projection 3. In the upright position, the locking projection 3 of the first sidewall 2 engages behind the detent of the second sidewall due to the spring force of the spring clip 6, thereby locking the two sidewalls with respect to each other.

Figure 2:
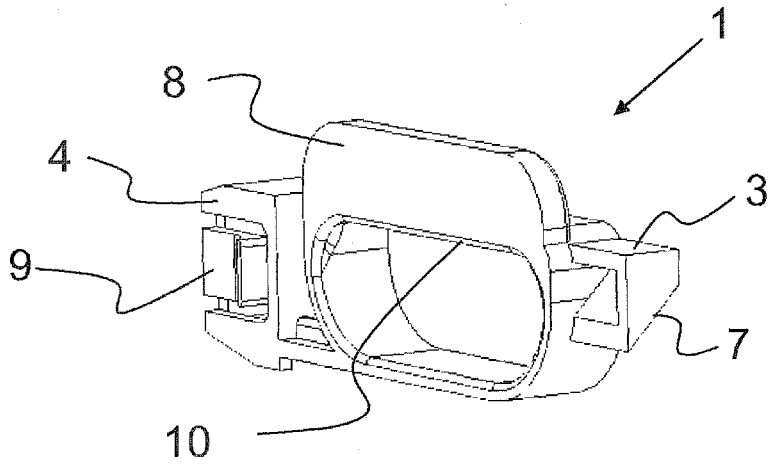
FIG. 2 a perspective view of a lock with the inside facing forward.

FIG. 2 shows a catch bolt 1 in a perspective view with the inside facing forward. Clearly visible is the catch element 4 located on the end of the spring element 6 that is to be fixedly connected with the sidewall 2. The catch element 4 has a snap-in tab 9 intended for securing the catch element 4 in the first sidewall 2.

Figure 3:
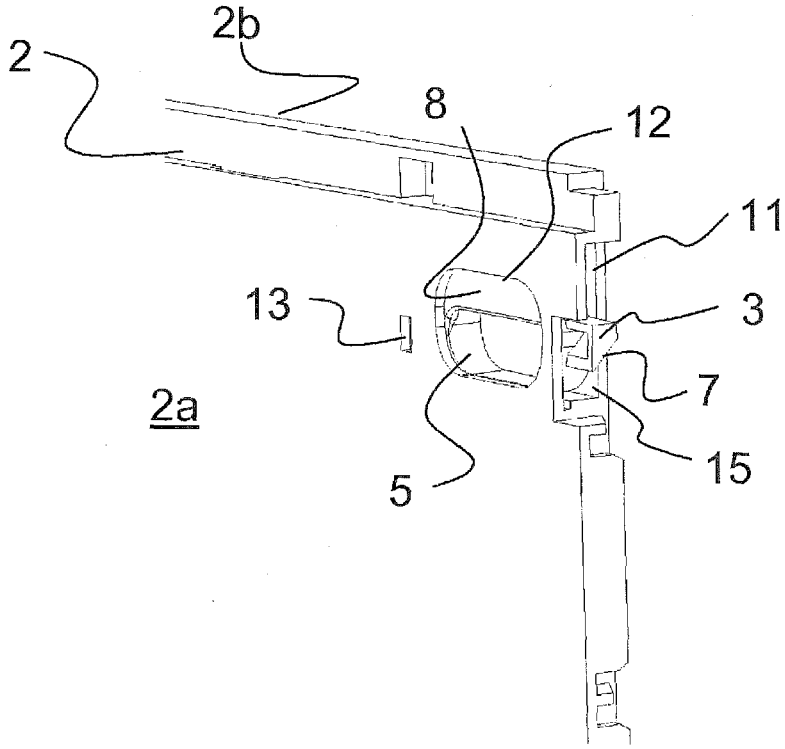
FIG. 3 a perspective view of a detail of a sidewall of the container, as viewed from the inside.

FIG. 3 shows in a perspective view a detail of a first sidewall 2 of the container in the upper corner region, as viewed from the inside. The first sidewall 2 is double-walled in the upper corner region. The recesses 15 for receiving the spring clip 6 or the catch bolt 1, respectively, are formed by the inside surface 2*a* and by the outside surface 2*b* of the double-walled section of the first sidewalls 2. When the catch bolt 1 is installed, the catch bolt 1 is inserted from the end face 11 of the first sidewall 2 into the recess 15 until the catch element 4 latches in the provided complementary recess. The snap-in tab 9 of the catch element 4 engages in the recess 13 in the inner lateral wall 2*a*, thereby securing the end of the spring clip 6. The free end with the locking projection 3 can be moved in the recess 15, i.e., in the plane parallel to the first sidewall 2, and can be raised by upwardly pressing or lifting the handle part 5. The inside surface 2*a* of the first sidewall 2 has a grip opening 12 located in the region of the double-walled section. The opening is designed so that when the handle 5 is pulled up as far as possible, the locking projection 3 is lifted until it disengages from the detent of the second sidewall, so that the first sidewall 2 can be collapsed downward. The bezel 8 formed on the handle 5 is configured to cover the opening 12 above the handle 5, thereby closing the cavity in the double-walled region of the sidewall 2 and preventing grasping behind the recess 15.

Figure 4:
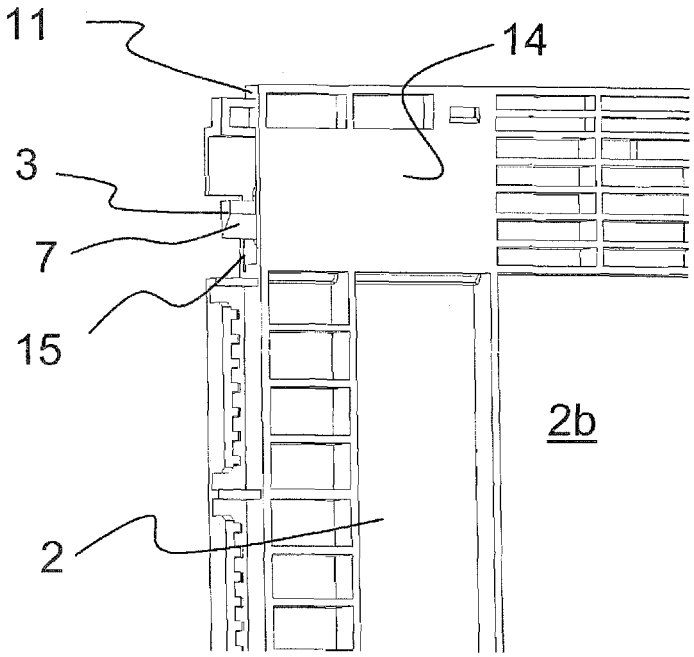
FIG. 4 a perspective view of a detail of a sidewall of the container, as viewed from the outside.

FIG. 4 shows a detail of a first sidewall 2 in an upper corner region from the outside. The outer side 2*b* of the sidewall 2 is visible, which is formed by a closed surface 14 the region of the double-walled section. The grip element 5 can then not be reached from the outside. For unlocking and collapsing the sidewalls, the grip elements 5 must be operated from the inside.

The aforedescribed foldable storage and transport containers mostly include top covers which can be locked, for example with seals, in order to prevent containers from being opened by unauthorized persons during transport of sensitive goods. The container according to the invention now has additionally an interlock of the collapsible sidewalls which can only be opened from the inside, i.e., when the top cover is open. When the top cover is closed, it is impossible to even partially collapse the sidewalls for obtaining unauthorized access to the content of the containers. Accordingly, these transport containers are provided with an interlock for the sidewalls which cannot be manipulated, and which is easy to manufacture and install.

The invention claimed is:

1. A collapsible plastic storage and transport container comprising:

a bottom part, four sidewalls arranged in an articulated manner on the bottom part and configured to be collapsible inwardly towards the bottom part;

top covers which can be locked, with two opposing first sidewalls of the four sidewalls having recesses at their upper corner regions and at least one catch bolt associated with an upper corner region and arranged in a recess of each of the first sidewall, said first sidewalls being provided in the upper corner regions with a double-walled configuration with an inside surface and an outside surface, with two opposing second sidewalls of the four sidewalls having detents disposed on edges of the two second sidewalls, wherein the at least one catch bolt engages behind a corresponding detent of the second sidewall to lock said first sidewall with said second sidewall, wherein the at least one catch bolt being a spring clip with a locking projection integrally formed at its free end, which the locking projection can be latched in a recess in the second sidewall and the spring clip having a grip part in the central region and an end opposite to the free end, which is fixedly connected to said first sidewall, such that the free end is moveable upwardly in said recess of the first sidewall against the spring force of the spring clip by upwardly pressing or lifting the grip part for disengaging the locking projection from the detent of the second sidewall, wherein the end of the spring clip is formed by a catch element with a snap-in tab which is integrally formed on the spring clip, said snap-in tap being latched in a complementary recess in the first sidewall; and a recess provided in the upper corner region of an end face of the first sidewall in order to insert the at least one catch bolt between the inside surface and the outside surface, until the snap-in tab engages into the recess in the inside surface and thereby tightly holds the end of the spring clip.

2. The collapsible container of claim 1, wherein the outside wall section of the double-walled structure is formed by a closed surface and the inside wall section comprises a grip hole in the region of the double-walled sections, such that the grip part of a spring element is configured to be operated, or moved in a limited way, only from inside the container.

3. The collapsible container of claim 1, wherein the grip part is formed by a substantially oval operating handle which is formed integrally with the spring clip, with the operating handle comprising a bezel extending upwardly from the bottom part and parallel to the first sidewall.

4. The collapsible container of claim 1, wherein the locking projection of the first sidewall has an inclined surface configured to run up on the detent of the second sidewall and to lock behind the detent, when a first sidewall is opened, as a result of restoring forces produced by a spring force of the spring clip.

* * * * *